United States Patent [19]

Bolli et al.

[11] Patent Number: 4,998,903

[45] Date of Patent: Mar. 12, 1991

[54] TOY ACTUATION SYSTEM

[75] Inventors: Peter Bolli, Steinhausen; Werner Tanner, Baar, both of Switzerland

[73] Assignee: Interlego A.G., Switzerland

[21] Appl. No.: 752,936

[22] Filed: Jul. 8, 1985

[30] Foreign Application Priority Data

Jul. 11, 1984 [CH] Switzerland ..... 3366/84

[51] Int. Cl.[5] ..... A63H 33/08

[52] U.S. Cl. ..... 446/102; 446/121; 446/128

[58] Field of Search ..... 446/90, 91, 102, 103, 446/85, 121, 120, 425, 428, 432, 424, 128, 107; 464/52, 53, 183, 901; 403/26, 305, 300; 254/98, 102

[56] References Cited

U.S. PATENT DOCUMENTS

| | | | |
|---|---|---|---|
| 2,420,219 | 5/1947 | Baldwin | 254/98 X |
| 2,586,359 | 2/1952 | Mall | 464/53 |
| 3,611,748 | 10/1971 | Wallgren | 464/52 |
| 3,613,291 | 10/1971 | Howe | 446/103 |
| 3,731,428 | 5/1973 | Glass et al. | 446/428 |
| 4,214,403 | 7/1980 | Knudson | 446/121 X |

FOREIGN PATENT DOCUMENTS

| | | | |
|---|---|---|---|
| 1058891 | 6/1959 | Fed. Rep. of Germany | 446/428 |
| 2620817 | 11/1977 | Fed. Rep. of Germany | 446/90 |

*Primary Examiner*—Mickey Yu

*Attorney, Agent, or Firm*—Kane Dalsimer Sullivan Levy Eisele and Richard

[57] ABSTRACT

For simulating hydromechanical actuation of components in a toy model such as a toy excavator having legs and a shovel, means for exclusively mechanical power transmission are provided. These means include actuating units comprising each a cylinder casing and a piston rod slidably arranged therein and displaceable by a threaded spindle in engagement with the piston rod. Rotary motion is transmitted to the threaded spindle by a flexible shaft having plug-in connectors at both ends secured to a core and a protective hose of the flexible shaft. Each flexible shaft is connected with a driving unit installed in the toy model and releasably connected with a rotary power source such as handwheel or an electric motor.

13 Claims, 3 Drawing Sheets

TOY ACTUATION SYSTEM

BACKGROUND OF THE INVENTION

The present invention relates to an actuation system for construction sets and especially for toy models such as toy models composed by building blocks.

In the Netherlands Patent Application No. 8204431, published on June 1, 1984, there is disclosed a driving system for toys comprising a continuously controllable driving unit including a flywheel power source, and flexible shaft transmitting rotary energy from the flywheel drive to an actuating unit in the toy. In addition to the transmission of rotary energy, by its core, the flexible shaft according to the afore-mentioned patent application also performs the functions of transmitting a translational control motion equally by translation displacement of its core and transmitting a rotational control motion by rotary displacement of its protective hose.

In the German Patent Application No. 22 25 239, published on Feb. 22, 1973, there is further disclosed a toy vehicle and drive means therefore which comprise a driving unit including a motor, a driving element and an actuating unit, the driving element being realized by a rigid shaft and the actuating unit including a device for converting the rotary motion of the shaft into a linear motion of a telescopic ladder of a fire brigade vehicle or a swivelling motion of a shovel of an excavator. These known driving systems for toys cannot be used for integration with the toy certain elements of which shall be actuated. They cannot be used universally with any type of toy and, in particular, they cannot be modified by the user to suit a specific toy model which has been constructed by the user as, for example, by means of known building blocks.

It is an object of the present invention to provide an actuation system for toy models comprising a driving unit, an actuating unit and a flexible shaft connecting the actuating unit with the driving unit which can be used in practically any type of toy model in an integrated form excluding exterior power sources and transmission means.

A further object is to provide such an actuation system which can be easily adapted to toy models which may be modified by the user to construct a toy model of different type and function.

A still further object is to provide such an actuation system which can be used as a basis outfit for actuating parts of construction sets composed by known building blocks.

A further object also is to provide an actuation system of the kind referred to which offers the aspect of a realistic representation of known hydraulic actuation system at the smaller scale of toy models for exerting either rotational or translational motion in the absence of any pneumatic of hydraulic transmission means.

SUMMARY OF THE INVENTION

The above and other beneficial objects and advantages are attained in accordance with the present invention by providing a toy actuation system comprising a driving unit which is adapted to be connected with an outer power source, a flexible transmission shaft which is adapted to be connected with the driving unit, and an actuating unit which is adapted to be connected with the flexible transmission shaft and which is constructed in a manner to supply either rotational or translational actuating power. The connections between the flexible shaft and the driving unit as well as the actuating unit are achieved in a releasable manner by means of plug-in couplings. A core and a protective hose of the flexible shaft are both provided at both ends of the flexible shaft with plug-in elements. The driving unit and the actuating unit comprise each a connecting bore the form and dimensions of which correspond to the plug-in element provided on the core of the flexible shaft. In addition, a respective casing of the driving unit and the actuating unit comprises a connecting socket which is adapted to receive the plug-in element provided on the protective hose of the flexible shaft. In addition, a respective casing of the driving unit and the actuating unit comprises a connecting socket which is adapted to receive the plug-in element provided on the protective hose of the flexible shaft.

Preferably, both the driving unit and the actuating unit when intended for supplying rotational actuating power comprise a coupling element which is supported in the casing of the units for rotational motion. In both units, one end of the coupling element and the corresponding end region of the casing are then adapted to be releasably connected with one end of the flexible transmission shaft, while the other end of the coupling element is adapted to be connected either to the rotary power source or to a structural member of the construction set to be actuated. Such connection may be achieved by providing similar output and input stub shafts on the rotary power source and the structural member, respectively, and by providing a bore at said end of the coupling element for positively receiving the stub shaft.

For supplying translational actuating power, the actuating unit preferably comprises a tubular piston rod which is disposed within an elongated casing for axial sliding displacement. The piston rod is provided with an element having an internal thread. A threaded spindle is disposed within the tubular piston rod and engages the threaded element of the piston rod. Further the threaded spindle has one end thereof adapted to be releasably connected with one end of the flexible transmission shaft whereby rotational motion of the core of the shaft in either senses causes translational displacement of the piston rod.

Preferably, the driving unit and the actuating units have at least substantially the outer form of a building block for toy construction sets.

Preferably the toy actuation system according to the invention is designed to simulate a hydromechanical actuation of a toy construction set in that the driving unit, the flexible transmission shaft and the actuating unit have an outer shape which simulates a hydraulic pump, a hydraulic lead and a hydraulic motor or a hydraulic cylinder with incorporated piston rod.

DETAILED DESCRIPTION OF THE PREFERRED EMBODIMENTS

Figure 1:
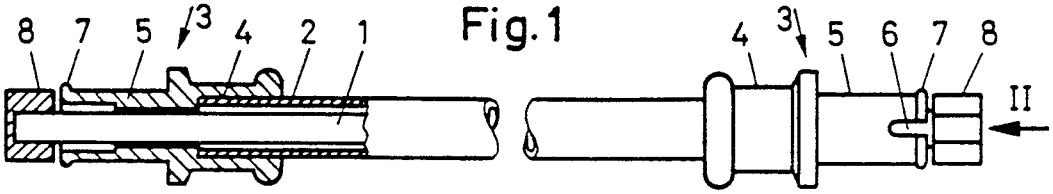
FIG. 1 is a plan view, partially in a longitudinal section, of a flexible transmission shaft which is provided at its both ends with plug-in couplings and which is designed to simulate a hydraulic hose.
Figure 2:
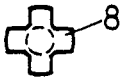
FIG. 2 is an end elevation view of a coupling element of the flexible transmission shaft in the direction of arrow II in FIG. 1.

Reference is now made to the drawings and to FIGS. 1 and 2 in particular wherein a flexible transmission shaft comprises in a known manner a shaft core 1 which may be a steel cord and which may be exposed to torsional forces. The shaft core 1 is provided with a protective hose 2 having an outer sheathing made of a plastic material. Both ends of the protective hose 2 are provided with a substantially cylindrical connecting element 3 made of a plastic material which comprises a grip portion 4 and a plug-in portion 5. The plug-in portion 5 is designed for introduction into a corresponding bore. Its end zone has two diametrically opposed slits 6 and a bead 7 provided for resilient introduction of the plug-in portion 5 into the afore-mentioned bore and for retaining the plug-in portion 5 in an annular groove in the wall of said bore as will be explained in detail below.

As may be seen in FIG. 1, the shaft core 1 passes beyond the connecting element 3 of the protective hose 2 at both ends thereof. The projecting ends of the shaft core 1 are provided with a coupling element 8 which according to FIG. 2 has the shape of a crossbar. The coupling element 8 may consist of a light-metal alloy such as an aluminium alloy, and it is firmly fixed to the shaft core 1, for example by a pressing process.

The flexible transmission shaft as shown in FIG. 1 has the purpose of simulating a hydraulic hose in a toy model by transmitting a mechanical moment of a rotation from a driving unit to an actuating unit such as in an actual machine a hydraulic fluid is transmitted from a hydraulic pump to a hydraulic motor or to a hydraulic power cylinder having a piston and a piston rod. To realistically simulate a hydraulic hose the outer diameter of the plastic sheathing of the protective hose 2 may be approximately 4 millimeters. The connecting elements 3 and the coupling elements 8 which transmit torque form advantageous snap couplings for the flexible shaft as will be further explained below.

Figure 3:
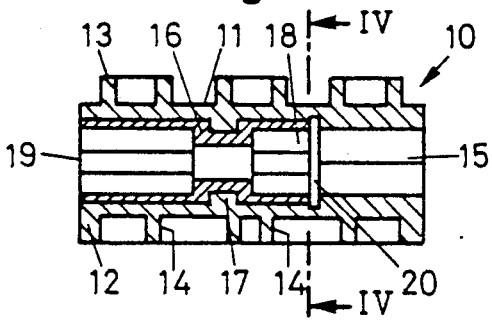
FIG. 3 is a longitudinal sectional view of a driving unit or actuating unit which simulates a hydraulic pump and a hydraulic motor, respectively.
Figure 4:
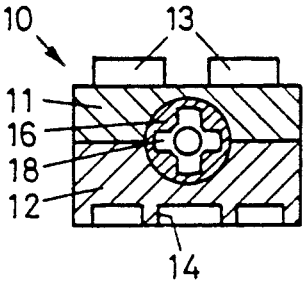
FIG. 4 is a sectional view of a driving unit or actuating unit along line IV—IV in FIG. 3.
Figure 5:
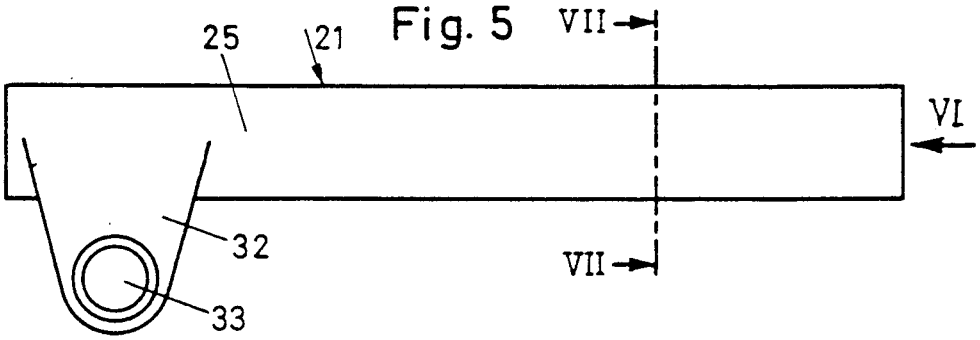
FIG. 5 is a plan view of a cylinder casing of an actuating unit which simulates a hydraulic power cylinder.
Figure 6:
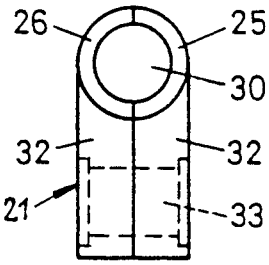
FIG. 6 is an end elevation view of the cylinder casing in the direction of arrow VI in FIG. 5.
Figure 7:
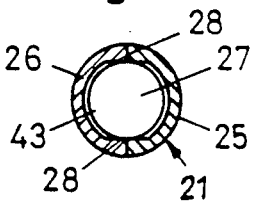
FIG. 7 is a sectional view of the cylinder casing along line VII—VII in FIG. 5.
Figure 8:
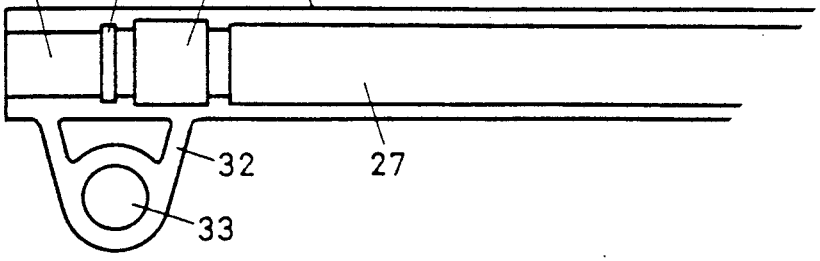
FIG. 8 is an inner view of one half of the cylinder casing of FIG. 5.

A driving unit to be coupled with the flexible shaft of FIGS. 1 and 2 is shown in FIGS. 3 and 4. The driving unit is used for transmitting torque from an outer power source (not shown) to the flexible shaft and to simulate thereby a hydraulic pump in a toy model.

The driving unit according to FIGS. 3 and 4 comprises an outer casing 10 made of plastic material and composed of two casing halves 11 and 12 which are fixedly joined one to the other. In the embodiment shown, the casing 10 is formed in accordance with a known toy building block as widely sold under the trade name "LEGO" both with respect to its outer aspect and its outer dimensions. Thus the casing 10 has on the top face of one of its halves 11 two rows of three coupling pins 13 and on the outer face of the other casing half 12, which is hollow, two projections 14 in the form of tubular sockets 14 for connection with the coupling pins of an adjacent similar building block.

The casing 10 has a stepped axial bore which on one axial side of the casing is formed as a connecting socket 15 adapted to reiceive the plug-in portion 5 of the connecting element 3 of the flexible shaft shown in FIG. 1. On the other axial side of the casing 10, a rotary element 16 made of a plastic material is radially and axially supported in the axial bore of the casing. The axial bearing of the rotary element 16 is achieved by a semi-circular annular projection 17 in each of the casing halves 11 and 12, these projections 17 engaging a corresponding annular groove in the rotary element 16. The rotary element 16 further comprises axial bores 18 and 19 on its two axial sides, the bores 18 and 19 being formed to positively receive the crossbar-shaped coupling element 8 fixed to the core 1 of the flexible shaft, see FIGS. 1 and 2. Therefore, the flexible shaft of FIG. 1 may be coupled to the driving unit of FIGS. 3 and 4 by simply plugging one end of the flexible shaft into the socket 15 and the axial bore 18 of the driving unit. Thereby the protective hose 2 of the flexible shaft is connected through its plug-in portion 5 with the socket 15 of the casing 10 of the driving unit, while the core 1 of the flexible shaft is positively joined through its coupling element 8 to the axial bore 18 of the rotary element 16 of the driving unit. The portion of the rotary element 16 comprising the axial bore 18 is of such length that an annular groove 20 is formed between the inner front face of the rotary element 16 and the inner end of the socket 15. The annular groove 20 will receive therefore, the bead 7 on the plug-in portion 5 of the flexible shaft shown in FIG. 1, and releasably retain the protective hose 1 of the flexible shaft, and with it the entire flexible shaft, in the casing 10 of the driving unit.

The other axial bore 19 in the rotary element 16 serves the purpose of receiving a crossbar shaped stub shaft of a rotary power source such as a handwheel, an electric motor, a gear or a reversible gear driven by an electric motor.

The driving unit shown in FIGS. 3 and 4 which in particular may be provided for simulating a hydraulic pump may identically and without any modification be used as an actuating unit which simulates a hydraulic motor and supplies rotary power. The other end of the flexible shaft the core of which is driven by the driving unit described above will be likewise coupled by simple plugging-in with the socket 15 and with the axial bore 18 in the rotary element 16 of a second similar casing 10, the axial bore 19 of which serving to receive a crossbar shaped stub shaft of a device which has to be rotationally actuated.

For producing the driving or actuating unit according to FIGS. 3 and 4, the rotary element 16 is inserted in one of the casing halves 11 and 12, the other casing half then being fixedly joined with the one casing half as, for example, by glueing, molding or snapping.

Of course, the casing 10 of the driving unit or the actuating unit may show any other outer shape which is in conformity with the system of construction sets used or which meets the requirements of a desired design.

A further embodiment of an actuating unit to be connected with the flexible transmission line of FIG. 1 will now be described by reference to FIGS. 5 to 14. That embodiment is designed for exerting translational power, and it simulates a hydraulic double-action cylinder having a piston rod for supplying the translational power. The actuating unit comprises a two-part cylinder casing 21 (FIGS. 5 to 8), a tubular piston rod 22 with a nut 23 inserted therein (FIGS. 9 to 12) and a threaded spindle 24 (FIGS. 13 and 14).

It can be seen from FIGS. 5 to 8 that the cylinder casing 21 consists of casing halves 25 and 26 which are substantially half-cylindrical and are formed as two symmetrical parts of a plastic material. The two parts are fixedly joined after having inserted the piston rod 22 and the threaded spindle 24 described in detail below into one of the casing halves 25 or 26. The casing 21 composed by the two casing halves 25 and 26 comprises an axial bore which has a plurality of sections having different diameters. A first section 27 serves to receive the tubular piston rod 22 (FIGS. 9 to 12) which is slidably displaceable in the axial direction. The first section 27 has a cross-section, as may be seen in FIG. 7, which is not exactly circular, but presents two diametrically opposed linear regions 28. As the piston rod 22 partially has a similar cross-sectional contour (FIGS. 9 to 11), it is prevented from rotating in the bore section 27; however, it can perform a displacement in the axial direction.

Figure 13:
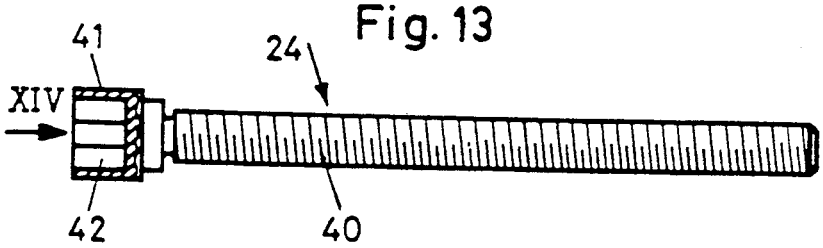
FIG. 13 is a plan view and partially a sectional view of a threaded spindle for the piston rod of FIGS. 9 to 11 which has been provided with the nut according to FIG. 12.
Figure 14:
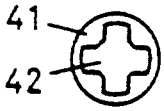
FIG. 14 is an end elevation view of a coupling portion of the threaded spindle in the direction of arrow XIV in FIG. 13.

A further bore section 29 serves to rotatably support a head portion of the threaded spindle 24 (FIG. 13). A third and last bore section 30 is formed as a connecting socket 15 of the driving unit previously described with reference to FIG. 3. An annular groove 31 again receives the bead 7 formed on the plug-in element 5 of the flexible shaft shown in FIG. 1.

Both casing halves 25 and 26 are provided with lateral flaps 32 which are molded with the respective casing half and are disposed one on the other, and which have a bore 33. The flaps 32 and the bore 33 serve the purpose of supporting the cylinder casing 21 in a swiveling manner in a construction set. In case a fixed support of the cylinder casing 21 is required instead of a swiveling support, the cylinder casing 21 may be clamped, for example, between conveniently formed construction elements such as building blocks.

Figure 9:
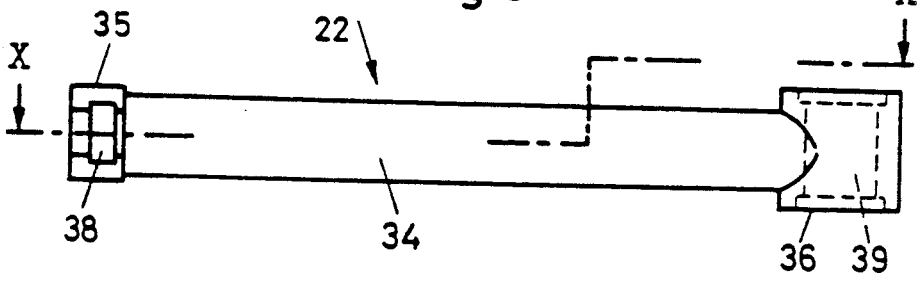
FIG. 9 is a plan view of a piston rod for a cylinder casing of the actuating unit according to FIGS. 5 to 8.
Figure 11:
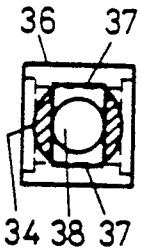
FIG. 11 is a sectional view of the piston rod along line XI—XI in FIG. 10.
Figure 10:
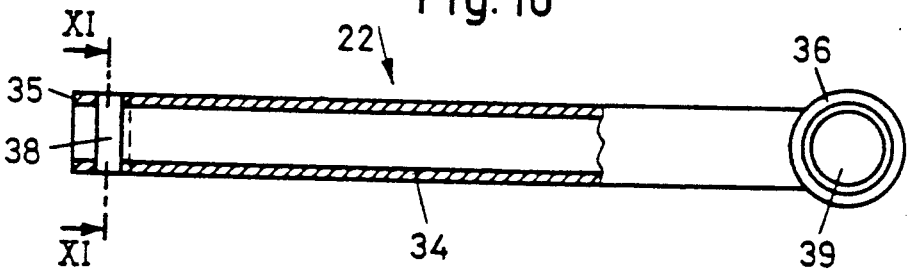
FIG. 10 is a longitudinal sectional view of the piston rod along line X—X in FIG. 9.
Figure 12:
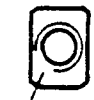
FIG. 12 is a plan view of a nut for the piston rod of FIGS. 9 to 11.

As may be seen from FIGS. 9 and 10, the tubular piston rod 22 which preferably is made of a plastic material has a cylindrical main section 34 provided at one of its ends with a head portion 35 and at its other end with a fastening lug 36, both being molded integrally with the tubular portion of the piston rod 22. The cross-sectional view of FIG. 11 shows that the contour of the head portion is not exactly cylindrical, but has two diametrically opposed flat portions 37 such that the piston rod when inserted into the bore section 27 of the cylinder casing 21 (FIGS. 5, 7 and 8) is secured in that bore section against rotational displacement. The head portion 35 further comprises a transverse opening 38 of rectangular cross-section which is provided for receiving a nut 23 shown in FIG. 12. The molded fastening lug 36 has a bore 36 for connecting the piston rod 22 with a structural member of the construction set to be actuated.

The threaded spindle 24 shown in FIG. 13 has a thread portion 40 and a head portion 41. The thread portion 40 fits to the nut 23 of the piston rod 22. The head portion 41 is radially and axially supported in the bore section 29 of the cylinder casing 21 (FIG. 8) to rotate therein. The head portion 41 further has an axial bore 42 which according to FIG. 14 has a cross-bar shaped cross-section matching the cross-sectional shape of the plug-in elements 8 (FIG. 1, 2) secured on the core 1 of the flexible shaft.

The assembly of the actuating unit the components of which are shown in FIGS. 5 to 14 is carried out in the following manner. The nut 23 is inserted into the transverse opening 38 of the piston rod 22. The threaded spindle 24 is then screwed into the nut 23 for a portion of its length. Hereafter, the piston rod 22 with the attached threaded spindle 24 is inserted into one of the casing halves 25 and 26 of the cylinder casing 21, the head portion 41 of the threaded spindle 24 being fitted into the bore section 29 of the cylinder casing 21. The cylinder casing 21 is then closed by placing the other casing half 26 or 25 on the aforementioned casing half 25 or 26, and by securing the casing halves one to the other in a known manner such as by glueing, molding or by a snapping effect.

Apparently, rotation of the core 1 (FIG. 1) of the flexible transmission shaft coupled with the actuating unit described above displaces the piston rod 22 having its fastening lug 36 axially projecting beyond the cylinder casing 21 in both axial directions depending on the sense of rotation, each rest position of the piston rod being self-locking. In order to prevent that the piston rod 22 may drop out from the casing 21 by continued rotation of the threaded spindle 24, an end range 43 of both casing halves 25 and 26 (FIGS. 7 and 8) has a circular crosssection with the diameter of the cylindrical main section 34 (FIGS. 9 and 10) of the piston rod 22. Therefore, the end range 43 forms a limit stop for the head portion 35 of the piston rod 22. The actuating unit as described and shown thus represents a true simulation of a double-action hydraulic cylinder having a piston rod.

Figure 15:
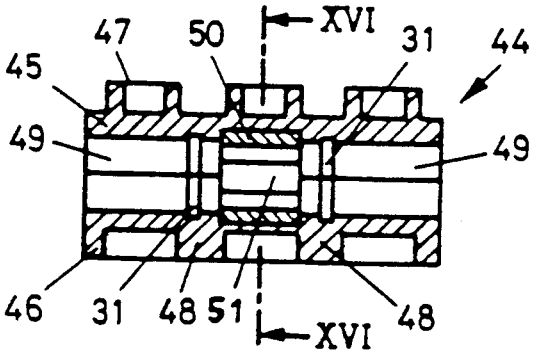
FIG. 15 is a longitudinal sectional view of a connecting socket for a pair of flexible transmission shafts according to FIGS. 1 and 2.
Figure 16:
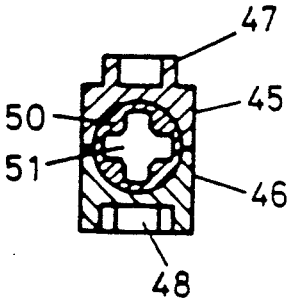
FIG. 16 is a sectional view of the connecting socket along line XVI—XVI in FIG. 15.

In order to achieve the connection of a pair of flexible transmission shafts according to FIGS. 1 and 2, a coupling member having plug-in means for respective ends of the flexible shaft may be used. An embodiment of such coupling member is shown in FIGS. 15 and 16. The coupling member referred to has a structure similar to that of the driving unit shown in FIGS. 3 and 4, and it comprises a casing 44 made of a plastic material. The casing 44 is composed of two casing halves 45 and 46 which are fixedly secured one to the other. In the embodiment shown, the casing 44 has again the outer form and dimensions of a building block for toy construction sets. Accordingly the casing 44 comprises on the outer face of the casing half 45 a row of three coupling pins 47 and on the outer face of the other casing half 46 two co-operating pins 48 for clamping the coupling pins of a further building block.

The casing 44 further comprises a stepped axial bore which is formed to provide at both axial sides of the casing a connecting socket 49 including a retaining groove 31 for receiving a plug-in element 5 of the connecting element 3 (FIG. 1) of the flexible transmission shaft as previously described. In a middle section of the axial bore, a coupling element 50 is axially and radially supported for rotational motion by the casing 44. The coupling element 50 has an axial bore 51 showing a cross-sectional contour which again corresponds to the cross-bar cross-section of the plug-in element 8 of the flexible shaft described before.

As has been previously mentioned it may be required for particular applications of the actuation system according to the present invention that a part of the toy model or construction set be actuated by two parallel actuating units which operate in conformity. Such parts may be, for example, a pair of supporting arms for a through in a model of a putting-down equipment or vehicle.

Parallel actuation may be achieved by use of the actuating units described above in a simple and satisfactory way by providing two or more actuating systems as described each comprising a driving unit, a transmission means in the form of a flexible shaft and actuating unit for supplying either rotational or translational actuating power, but by providing but a single rotary power source such as a handwheel or an electric motor for all driving units. In that case, all inputs of said driving units according to FIGS. 3 and 4 will then be coupled one with the other and with the single power source by suitable mechanical coupling means such as spur gears, bevel gears, etc. and associated shafts or stub shafts. Thereby, all flexible shafts connected with said at least two driving units will rotate in conformity, and therefore, the effects of rotation or translation of the respective actuating units will always be identical.

In case different movable members in a construction set have to be actuated from a single rotary power source such as handwheel or an electric motor, it will be suitable to arrange for a change-over gear disposed between the single power source and the driving units associated with each movable member through respective flexible transmission shafts and actuating units. With the aid of appropriate control means such as control levers one or more driving units may be selectively coupled with the single power source. In that way, a realistically operating model of a machine or vehicle such as an excavator may be obtained, in particular when the rotary power source is an electric motor.

Figure 17:
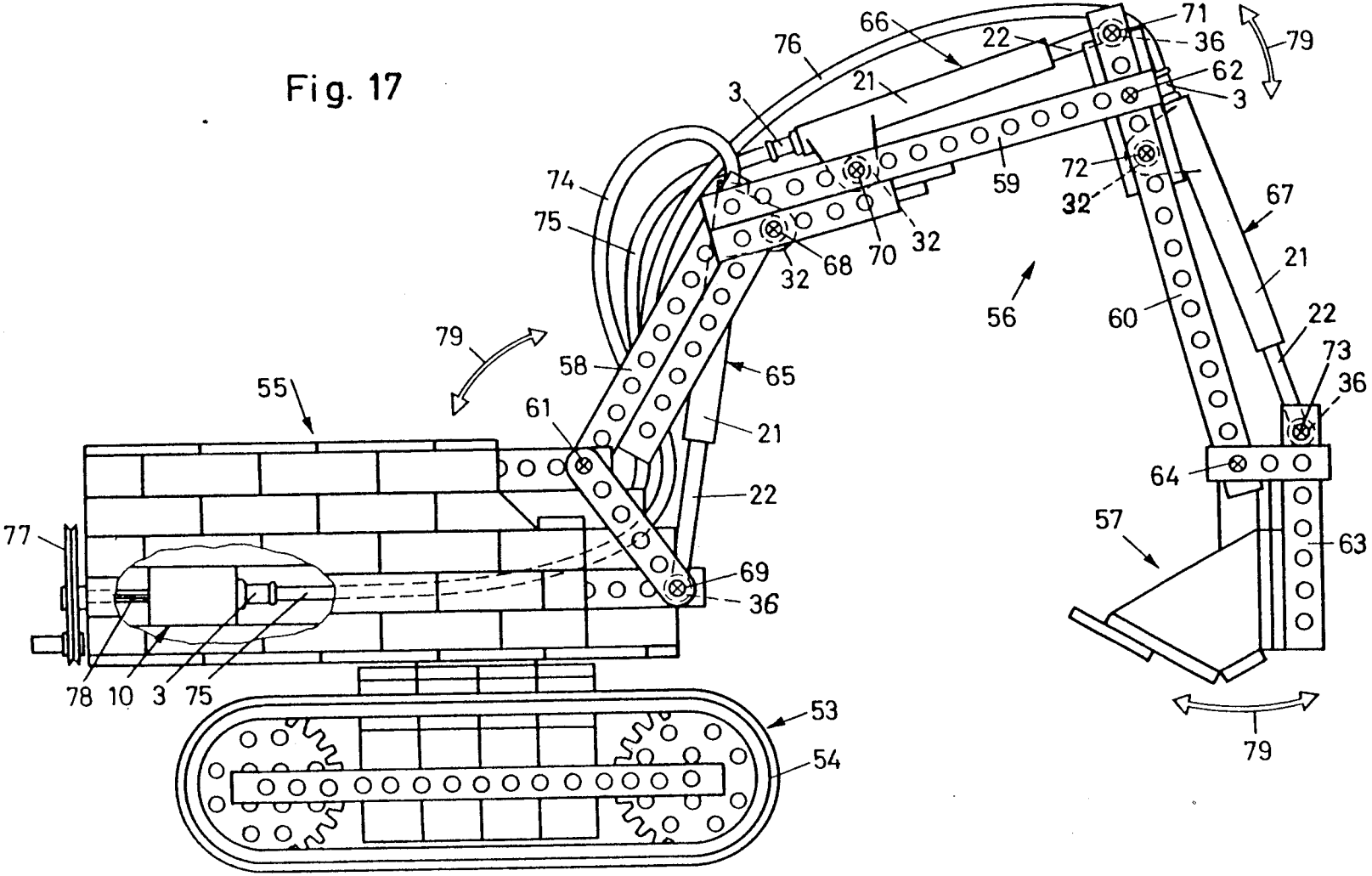
FIG. 17 is a side view of a toy excavator composed by building blocks and comprising a plurality of actuation systems according to the present invention.

By way of example and with reference to FIG. 17, a toy model comprising a plurality of actuation systems according to the present invention will now be described. The model shown is that of an excavator composed of known building blocks which are adapted to be put together by simple pressing. The excavator has a boom and a shovel which both can be swiveled by means of associated handwheels.

The model shown comprises an undercarriage 53 with caterpillar tracks 54, an engine frame 55 and a boom 56 with a shovel 57 supported by the engine frame 55.

The boom is constituted by three legs 58, 59 and 60. A first leg 58 is pivotally attached to the engine frame 55, the swivel axis 61 being indicated by a cross. A second leg 59 is fixedly attached to the first leg 58, i.e., the first and second legs form an invariable angle. A third leg 60 is pivotally attached to the second leg 59 through swivel axis 62. The shovel 57 is provided with a support 63 which is pivotally attached to the third leg 60 through a swivel axis 64.

In order to produce swivelling motion of the firmly connected legs 58 and 59 with respect to the engine frame 55, of the leg 60 with respect to the assembly of the arms 58 and 59, and of the shovel 57 with respect to the arm 60, each pair of these components is bridged by an actuating unit 65, 66 and 67, respectively. The actuating units 65, 66 and 67 are designed to simulate a hydraulical cylinder with an associated piston rod, and they are constructed in accordance with the embodiment of an actuating unit as previously described and shown in FIGS. 5 to 14 to which reference is made here.

The casing 21 of the first actuating unit 65 is pivotally supported on the leg 59 at the flap 32 of the casing 21 through a swivel axis 68. The fastening lug 36 of the piston rod 22 of the actuating unit 65 is pivotally attached to the engine frame 55 through a swivel axis 69. The casing 21 of the second actuating unit 66 is pivotally supported on the leg 59 at the flap 32 of the casing 21 through a swivel axis 70. The fastening lug 36 of the piston rod 22 of the actuating unit 66 is pivotally attached to the leg 60 through a swivel axis 71. The casing 21 of the third actuating unit 67 is pivotally supported on the leg 60 at the flap 32 of the casing 21 through a swivel axis 72. The fastening lug 36 of the piston rod 22 of the actuating unit 67 is pivotally attached to the support 63 of the shovel 57 through a swivel axis 73.

A flexible transmission shaft 74, 75, 76 is connected with the casing 21 of each actuating unit 65, 66, 67 through a plug-in element 3 as shown in FIG. 1. The flexible shafts 74, 75 and 76 which simulate hydraulic leads, are conducted through the interior of the engine frame 55. The interior of the engine frame 55 also contains three driving units 10 constructed as shown in FIGS. 3 and 4, the other ends of the flexible shafts 74, 75 and 76 being connected each with. one of these driving units through a respective plug-in element 3. In FIG. 17, one of these driving units 10 with attached flexible shaft 75 may be seen through a portion of the side wall of the engine frame 55 which has been broken away. The remaining driving units to which the flexible shafts 74 and 76 are attached cannot be seen in FIG. 17, because all driving units 10 are mounted in a horizontal plane. A handwheel 77 is associated with each driving unit 10, the connection being achieved by a stub shaft 78 as has already been explained with reference to FIGS. 3 and 4.

The construction and the arrangement of the actuating units 65, 66 and 67 and their associated flexible shafts 74, 75 and 76, respectively, truly reproduce hydromechanical actuation means as commonly provided in a real excavator. In particular, the course of movements of the boom 56 and the shovel 57 as resulting from a rotation of the handwheels 77 and as indicated by arrow 79 is quite natural and exactly corresponds to that of a real excavator. Moreover, the mechanical power transmission from the handwheels to the boom and shovel is extremely precise and, in addition, self-locking. Therefore, the toy model shown in FIG. 17 by way of example has a high playing value.

Instead of the handwheels 77, other power sources such as one or several battery-energized electric motors including gears may be provided and mounted within the engine frame 55. Such means for actuating the boom 56 and the shovel 57 may also be combined with additional means for moving the undercarriage 53 on the floor or ground and for rotating the engine frame 55 with respect to the undercarriage 53.

We claim:

1. A toy actuation system for construction sets and especially for toy models, comprising a driving unit having a casing adapted to be connected to a rotary power source, a flexible transmission shaft having an inner core and an outer protective hose, said shaft being adapted to be connected by one end thereof with said driving unit, and an actuating unit having a casing adapted to be connected with the other end of said shaft, said actuating unit including means for supplying rotational or translational actuating power, said connections of said flexible transmission shaft with said driving unit and said actuating unit being achieved in a releaseable manner by means of respective plug-in couplings, said core and said protective hose of said flexible shaft comprising each at each end of said flexible shaft respective first and second plug-in elements, wherein said first plug-in element provided on said core of said flexible shaft at each end thereof is a pin of cruciform cross-section secured to said core, wherein said second plug-in element provided on said protective hose of said flexible shaft at both ends thereof is a sleeve secured to said hose an outer end portion of said sleeve projecting beyond said hose and being provided with a resilient bead and with axially extending slits, and wherein said driving unit and said actuating unit each comprise a cylindrical coupling element supported in said respective casing for rotational motion, said coupling element being provided at least at one end thereof with a connecting bore having a cruciform cross-section corresponding to and for receiving said first plug-in element provided on said core of said flexible shaft, and said casings of said driving unit and said actuating unit each have at least at one end thereof a connecting socket comprising an annular groove for receiving said annular bead of said second plug-in element provided on said protective hose of said flexible shaft, thereby releasably retaining said second plug-in element in said connecting socket.

2. The actuation system in accordance with claim 1 including a second flexible transmission shaft having an inner core and an outer protective hose identical with those of said flexible transmission shaft and further comprising a coupling member having a casing for connecting said two flexible transmission shafts, said coupling member comprising a coupling element rotatably supported in said coupling member casing, said coupling element in said coupling member casing having an axial through-bore the crosssection contour of which corresponds to the cruciform crosssection of said first plug-in element secured to said core of each of said flexible transmission shafts, and said casing having a connecting socket at both ends thereof for receiving said second plug-in element secured to the protective hose of each of said flexible transmission shafts.

3. The actuation system in accordance with claim 2 wherein said coupling member casing consists of two halves having idential inner faces and being fixedly secured one to the other.

4. The actuation system in accordance with claim 2 wherein said coupling member casing has the outer form of a square building block for toy construction sets.

5. The actuation system in accordance with claim 1 wherein said casing (10) consists of two driving unit casing halves (11,12) having identical inner faces and being fixedly secured one to the other.

6. The actuation system in accordance with claim 1 wherein said driving unit casing (10) has the outer form of a building block for toy construction sets.

7. The actuation system in accordance with claim 1 wherein said driving unit and said actuating unit are identical.

8. The actuation system in accordance with claim 1 wherein the actuating unit comprises a tubular piston rod (22) disposed within an actuating unit casing (21) for axial sliding displacement, said piston rod (22) being provided with an element (23) having an internal thread, and a threaded spindle (24) disposed within said tubular piston rod (22) and engaged with said threaded element (23), said threaded spindle (24) having one end (41) thereof adapted to be releasably connected with one end of said flexible transmission shaft (1,2).

9. The actuation system in accordance with claim 8 wherein said actuating unit casing (21) comprises a lateral flap (32) disposed at the casing end near said one end (41) of said threaded spindle (24), said flap (32) having a bore (32) for swivel mounting of said actuating unit in a construction set.

10. The actuation system in accordance with claim 8 wherein said tubular piston rod (22) is received in an axial bore (27) of said actuating unit casing (21) for axial sliding displacement therein, at least a head portion (35) of said piston rod (22) having a non-circular cross-sectional contour for securing said piston rod (22) against rotation, said axial bore (27) being provided with a limit stop for said head portion (35) of said piston rod (22) whereby said piston rod (22) is prevented from being moved out of said casing (21).

11. The actuation system in accordance with claim 8 wherein said element (23) having an internal thread is a nut which is inserted into a slitlike transverse opening (38) in said piston rod (22).

12. The actuation system in accordance with claim 8 wherein said piston rod (22) comprises fastening means (36) at one end thereof which projects over said actuating unit casing (21), said fastening means (36) being adapted for connection with a structural member of the construction set to be actuated.

13. The actuation system in accordance with claim 8 wherein said threaded spindle (24) has a cylindrical head portion (41) which is axially and radially supported in a corresponding bore (29) of said actuating unit casing (21), said head portion (41) being adapted to releasably receive one end of said flexible transmission shaft (1,2) for rotating said threaded spindle (24) in an invariable axial position.

* * * * *